United States Patent [19]

Schambeck

[11] Patent Number: 4,669,143

[45] Date of Patent: Jun. 2, 1987

[54] SUPPORT SYSTEM FOR A MULTIPLE-SPAN BRIDGE

[75] Inventor: Herbert Schambeck, Frieding/Andechs, Fed. Rep. of Germany

[73] Assignee: Dyckerhoff & Widmann Aktiengesellschaft, Munich, Fed. Rep. of Germany

[21] Appl. No.: 714,956

[22] Filed: Mar. 22, 1985

[30] Foreign Application Priority Data

Mar. 22, 1984 [DE] Fed. Rep. of Germany ..... 3410438

[51] Int. Cl.[4] ..... E04C 3/02

[52] U.S. Cl. ..... 14/17; 14/73; 52/262

[58] Field of Search ..... 14/1, 17, 73; 52/262, 52/263

[56] References Cited

U.S. PATENT DOCUMENTS 4,123,815 11/1978 Neff ..... 14/17 X

FOREIGN PATENT DOCUMENTS

| | | | |
|---|---|---|---|
| 133850 | 3/1985 | European Pat. Off. | 14/1 |
| 1939737 | 2/1971 | Fed. Rep. of Germany | 14/17 |
| 2633668 | 7/1977 | Fed. Rep. of Germany | 14/17 |
| 2723770 | 12/1978 | Fed. Rep. of Germany | 14/1 |
| 2902381 | 3/1980 | Fed. Rep. of Germany | 14/17 |
| 2911239 | 10/1980 | Fed. Rep. of Germany | 14/1 |
| 3000673 | 7/1981 | Fed. Rep. of Germany | 14/1 |
| 3144558 | 5/1983 | Fed. Rep. of Germany | 14/73 |
| 837995 | 6/1981 | U.S.S.R. | 14/1 |

*Primary Examiner*—Stephen J. Novosad
*Assistant Examiner*—John F. Letchford
*Attorney, Agent, or Firm*—Toren, McGeady and Goldberg

[57] ABSTRACT

A support system for a multiple-span bridge constructed of reinforced concrete or prestressed concrete includes a primary structure and a secondary structure. The primary structure bridges the spans between intermediate supports or between an abutment and an adjacent intermediate support and includes serially arranged support members elongated in the long direction of the bridge. The width of the support members is a fraction of the full useful width of the bridge. The secondary structure forms the roadway slab and is supported on the primary structure. The secondary structure is made up of serially arranged individual roadway sections extending in the long direction of the bridge. The roadway sections are supported by bearing members resting directly on the support members of the primary structure with the roadway sections being closely spaced in the elongated direction of the bridge as compared to the spans between the intermediate members and the abutments. The roadway sections extend over the expansion joints between the support members. The roadway sections can have a dimension in the elongated direction which is comparable to that of the support members or which is a multiple of the length of the support members. The support members can be constructed in place on the bridge, while the roadway sections can be constructed at a single site and then moved over the support members into their final position on the bridge.

7 Claims, 8 Drawing Figures

SUPPORT SYSTEM FOR A MULTIPLE-SPAN BRIDGE

BACKGROUND OF THE INVENTION

The invention is directed to a multiple-span bridge support system constructed of reinforced concrete and/or prestressed concrete and including a primary structure for bridging the span between abutments and intermediate supports and made up of elongated support members extending in the long direction of the bridge and having a width transverse of the long direction which amounts to a fraction of the full useful width of the bridge. A secondary structure forming the roadway slab is supported on the primary structure. The invention is also directed to the method of constructing the primary structure and the secondary structure. In addition to the construction of a large bridge with a single large span, the construction of multiple-span bridges made up of many small spans where the roadway is located only slightly elevated above the ground surface is of increasing importance. Basically, to cut down on construction costs in building such bridges it is necessary not only to have a simple and easily determinable static arrangement and to obtain the optimum utilization of the construction materials being employed, but also to provide economical construction methods. In this regard, step-by-step construction methods have been developed in which the construction processes take place successively in multiple sequences.

For reinforced concrete and/or prestressed concrete bridges with large spans, a closed box-type cross-section is preferred for the superstructure. Moreover, in the cross-sections governing the dimensions of the upper roadway slab as well as of the lower base plate, it is attempted to fully utilize the compressive stress of the concrete and also to employ the torsional strength of the box-type section.

In small spans with a sufficient height, the compressive strength of the roadway slab and the base plate cannot be utilized. Dispensing with the base plate leads to a T-beam cross-section often employed in middle-sized and small spans. The roadway slab cannot be eliminated nor can its cross-section be reduced, since it provides the requisite roadway surface.

The monolithic construction of horizontal slabs and vertical or diagonal girder webs, as employed in a closed box-type cross-section and in an open T-beam cross-section, has advantages and disadvantages. With regard to small spans, the disadvangages predominate. This is particularly true when the roadway slab includes a tension region, that is, in cantilevered sections and in continuous girders in the support area. The so-called "effective slab width" to be taken into account for absorbing the bending moments is usually smaller than the overall width of the slab especially in wide bridges. The longitudinal forces developed in prestressing, however, are distributed across the entire width of the slab. As a result, in contrast to a cross-section with the smallest possible tension region, additional prestressing steel is required in the long direction and, moreover, additional steel is needed for introducing the shearing forces into the roadway slab. This is also true in certain cases if the roadway slab experiences compressive stresses.

It is true in bridges constructed in place where the roadway slabs are poured together with the webs or at least directly adjoining the webs that the advantages gained in the construction system where the cross-section is divided into successive concreting steps, cannot be utilized.

SUMMARY OF THE INVENTION

Therefore, it is the primary object of the present invention to provide an effective support system for a multiple-span bridge constructed of reinforced concrete and/or prestressed concrete where the support system is statically and structurally effective and also to provide an effective and economical method for constructing the support system.

In accordance with the present invention, the secondary structure is made up of serially arranged roadway sections separated from one another by expansion joints extending transversely of the long direction of the bridge. The roadway sections are supported on bearings which rest directly on the elongated support members of the primary structure with the roadway sections being spaced closely apart relative to the length of the bridge spans. Further, the roadway sections extend across the expansion joints between the support members forming the primary structure without any additional support for the roadway sections extending between or cantilevered relative to the support members. The expansion joints between the serially arranged roadway section of the secondary structure are offset in the long direction of the bridge relative to the expansion joints in the primary structure. It is advisable to space the expansion joints in the secondary structure a greater distance apart than in the primary structure.

The bearings which form the medium for supporting the secondary structure on the primary structure are preferably pivot bearings movable on all sides and they are formed of an elastomer material. Further, at least one fixed bearing is incorporated into each section of the secondary structure for each elongated support member for transmitting horizontal forces directed in the long direction into the primary structure.

It is advisable that the length of the sections of the secondary structure be a multiple of the length of the elongated support members of the primary structure where the length corresponds to the length of the individual spans. By a corresponding arrangement of fixed and movable bearings, several units of the primary structure can be connected together by a section of the secondary structure for transmitting the horizontal forces extending in the long direction of the bridge into the fixed bridge supports or piers.

Preferably, the support members forming the primary structure are girders extending across a single span.

A significant feature of the invention is the separation of the support members making up the primary structure from the roadway slab forming the secondary structure with the roadway slab extending across the spacing between support members in the transverse direction of the bridge and forming the full useful bridge width. Accordingly, a simple static relationship is provided between the parts forming the primary and the secondary structure and the parts can be sized and constructed in an optimum manner with regard to the way in which the parts are used. In a simplified arrangement, the elongated support members receive only vertical forces as a result of vertical load transferred through transverse members, that is, no bending movements are developed in the transverse direction of the elongated support members. Furthermore, the elongated support members can be prestressed in accordance with their small cross section without the prestressing force being directed into the roadway slab. Since the roadway slab does not have to be prestressed or needs to be presetressed only to a slight degree, the slab undergoes no deformation through creeping of the concrete in the long direction of the bridge. Accordingly, displacements in the long direction in bearings and in transition structures remain smaller relative to the undivided prestressed concrete cross-sections with the same spacing of the roadway transition structure bridging the transverse expansion joints.

The present invention is particularly advantaqeous where the primary structure is made up of oppositely projecting cantilevered arms with the cantilever arms being connected with supports fixed in the bridge foundations so that they are bending resistant.

The cantilevered arms of the support members can be connected together at their ends by means of articulated joints for shearing forces, however, this is not necessary.

The fixed bearings located between the secondary primary structures are preferably located in the region of the vertical support supporting the primary structure. It is also advantageous to locate the expansion joints in the secondary structure in the region of the vertical supports.

A frame support system results due to the secondary structure being connected at the primary structure with fixed bearings. Such frame support system offers the advantages known in conventional systems such as absorbing horizontal braking forces by several piers and reducing the bending moments in the supports. Moreover, constraining forces due to the reduction in length of the elongated support members because of prestressing are avoided because the compressive stress due to the prestressing force is not impeded and the secondary structure does not need to be prestressed in the elongated direction or, if it is, only to an insignificant degree, since it has no longitudinal support effect.

The cantilevered arm arrangement is of particular importance, however, in that the shearing force joints at the ends of the cantileverd arms are not needed. If the secondary structure, which is supported on the primary structure by bearings closely spaced from one another, has no expansion joints in the region of the expansion joints in the primary structure then it can assume the function of a transverse force joint. The bearings for the secondary structure are preloaded to such an extent by the weight of the structure that the secondary structure cannot lift itself due to an unfavorable live load and, accordingly, transverse forces can be carried by the joint. Apart from the cost reductions achieved, the structural simplification and the elimination of maintenance, the joints in the primary structure can be sufficiently wide so that the tension members of the cantilever arms can be tensioned at the end faces without any danger of buckling the roadway in the region of the joint, since the end face is rounded by the secondary structure.

With regard to the construction operations, there is the advantage, since only a primary structure which makes up no more than a third of the total mass of the superstructure needs to be constructed at the site of the bridge, that the entire secondary structure can be constructed at a single site and then moved into the final position on the bridge. The single construction site can be located adjacent the bridge abutment and spaced from the bridge or located along the length of the bridge from which location roadway sections can be moved in opposite directions along the bridge.

A further advantage of the invention is that the roadway sections of the secondary structure can be moved over the primary structure moving over the bearings located closely spaced from one another so that the known disadvantages of step-by-step assembly method do not occur.

The sections of the secondary structure can be produced successively as individual parts and then connected together by concreting before being moved into the final position after the completion of each section. After reaching the final position, two or more sections of the secondary structure can be connected together.

Finally, it is possible to connect the sections of the secondary structure with the elongated support members of the primary structure so that shear resistance and/or bending resistance are achieved in the final position.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
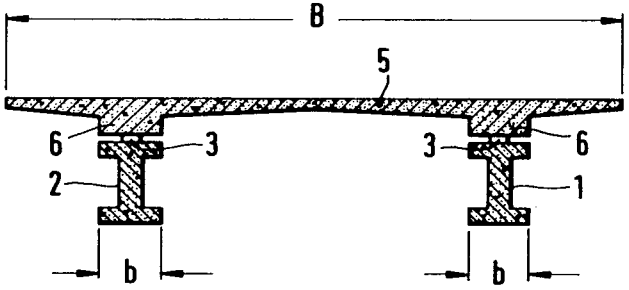
FIG. 1 is a cross-section through the superstructure of a bridge support system embodying the present invention.

In the cross-section of the bridge superstructure, illustrated in FIG. 1, the primary structure includes a pair of elongated girders 1, 2 spaced laterally apart and extending in the long direction of the bridge. Each of the girders 1, 2 has an I-shaped cross-section. On the upper flange of the I-shaped girders, bearings 3 are located in closely spaced relation. The secondary structure, in the form of a roadway slab is supported on the bearings 3. The roadway slab extends in the long direction of the girders 1, 2 and also transversely between the girders with cantilevered sections projecting outwardly on both sides of the girders. Directly above the girders 1, 2, the roadway slab has an increased thickness section resting on the bearings. The bearings 3 are constructed as pivot point bearings made up of an elastomer material. The width b of the elongated girders 1, 2 is small relative to the overall useful width B of the roadway slab 5.

In FIGS. 3 to 6 bridge support systems are shown in schematic side view and vary structurally with respect to the static system. The span of the elongated girders 1, 2 of the primary structure is designated by L that is, the spacing between the vertical supports 7, 15, 20 providing the vertical support for the girders. As a rule, the span L is the same for all of the elongated girders 1, 2. The elongated girders 1, 2 are single span girders extending between intermediate vertical supports 7 or between an intermediate support 7 and an abutment 8 in a known manner with the girder resting on a fixed bearing 9 at one end and a movable bearing 10 at the other end, note FIG. 3.

Along the upper sides of the elongated girders 1, 2, elastomer material bearings 3, acting as movable pivot point bearings, are spaced closely apart at a distance 1 which distance is small as compared to the span L. The individual roadway sections 5*a*–5*d* of the roadway slab 5 are supported on the bearings 3. In addition, a fixed bearing 11 is provided in the region of each individual section 5*a*–5*d* for transmitting horizontal loads, such as braking loads.

Figure 3:
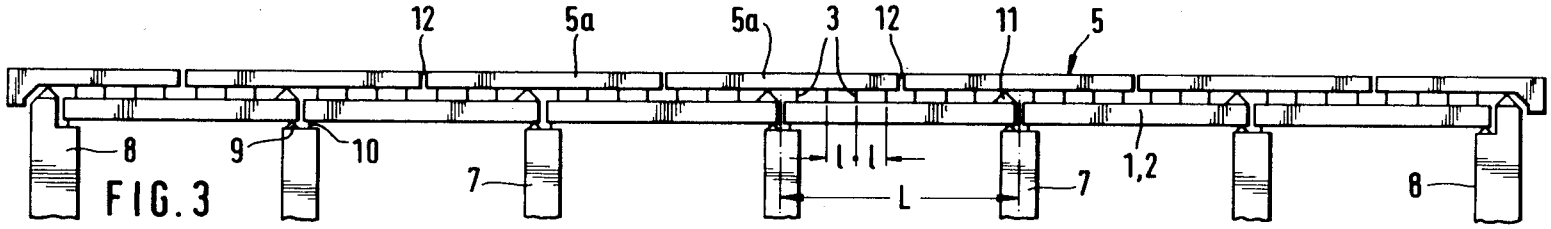
FIGS. 3 to 6 are schematic side views of different embodiments of multiple-span bridge support systems, embodying the present invention, and utilizing different static systems.

In the bridge support system in FIG. 3, the sections 5*a* of the roadway slab have the same length as the elongated girders: 1, 2, however, the sections are displaced in the long direction relative to the girders so that the expansion joints 12 between the sections 5*a* are located at the mid-span of the girders 1, 2. In other words, the expansion joints 12 between the roadway sections 5*a* are spaced in the long direction of the bridge relative to the expansion joints between the elongated girders 1, 2.

Figure 4:
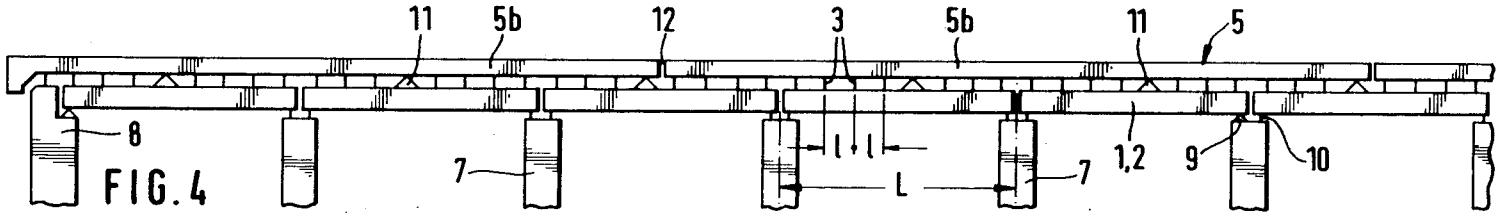

The embodiment in FIG. 4 corresponds substantially to that in FIG. 3, however, the roadway sections 5*b* are of a greater length than the elongated girders 1, 2 so that a single roadway section 5*b* extends over and along several elongated girders 1, 2. Along the length of each girder 1, 2 there is at least one fixed bearing 11 in addition to the elastomer material bearings 3 to ensure the transmission of the horizontal forces extending in the long direction of the bridge. As a result, several elongated girders 1, 2 are connected with one another by the longer roadway section 5*b* so that along the length of each roadway section 5*b* only one fixed bearing 9 is required for the elongated girders, note that one fixed bearing 9 is located at the abutment 8 and another fixed bearing is positioned atop a vertical support 7 spaced from the abutment 8 by several other vertical supports.

Figure 5:
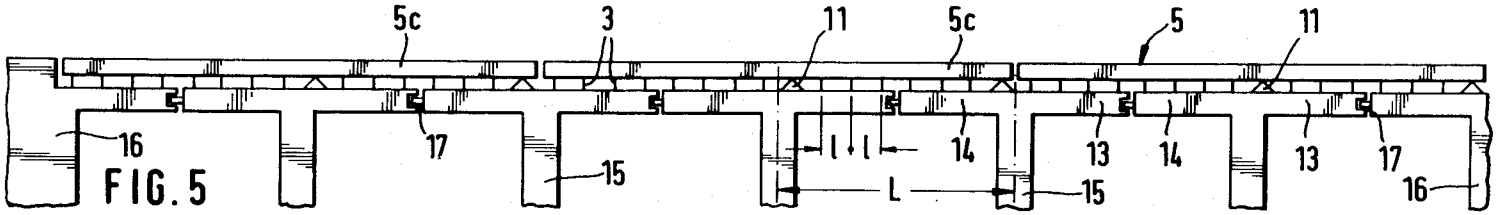
Figure 6:
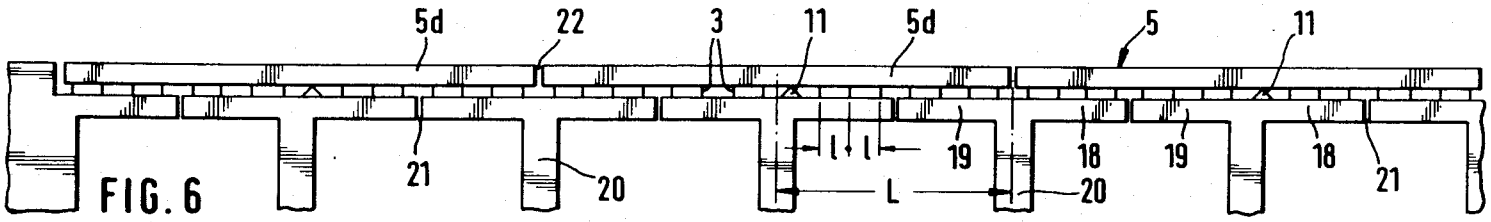

In FIGS. 5 and 6 a completely different static system is disclosed. In these figures the primary structure consists of single strut frames, note FIG. 5 where horizontal cantilever arms 13, 14 project outwardly from the opposite sides of the upper end of a vertical support 15. A similar construction is provided at the abutment 16 where a single cantilever arm extends from the upright abutment. The vertical supports 15 are fixed at their bases in a foundation, not shown, so that they are bending-resistant.

In the support system illustrated in FIG. 5, shearing force joints 17, capable of transmitting only shearing forces but not longitudinal forces or bending moments, are provided between the adjacent ends of cantilever arms 13, 14. Roadway sections 5*c* of the roadway slab 5 are supported on the cantilever, arms 13, 14 by elastomer material bearings 3 and fixed bearings 11 similar to the bearing arrangements described above. In the region of each strut frame there is a fixed bearing located above the vertical support 15, that is, at the zero point of movement.

An especially advantageous embodiment of this construction is set forth in FIG. 6. This construction utilizes a pair of cantilever arms 18, 19 connected in a monolithic manner with a rigid vertical support 20 affording an economical arrangement. The pair of cantilever arms 18, 19 of the primary structure serve only as a support for the roadway slab on which the sections 5*d* are supported on the closely spaced elastomer material bearings 3 and the fixed bearing 11. If the roadway slab 5 does not have any expansion joints in the region where the support arrangement has expansion joints 21, then the slab can assume the function of a so-called shearing force joint, for the transmission of shearing forces during an asymmetrical live load. The bearings 3, located adjacent to the expansion joint are preloaded to such an extent due to the apparent weight of the roadway slab 5 that the slab cannot rise under a live load and, accordingly, shearing forces can be carried away via the joints. The fixed bearings 11, arranged in each roadway section 5*d* of the secondary structure supported on the primary structure, has at least one such bearing. Note that the fixed bearings 11 in FIG. 6 are located approximately above the vertical support 20.

Figure 2:
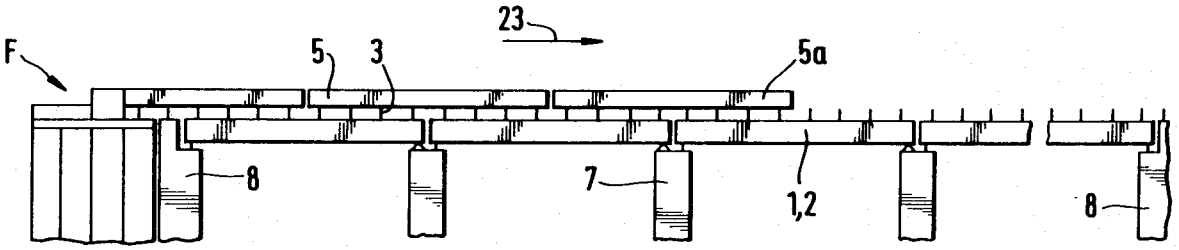
FIG. 2 is a schematic side view illustrating the production of a multiple-span bridge support system.

In accordance with the present invention which separates the bridge structure into two parts, that is, a primary structure and a secondary structure, it also affords besides the static structural advantages, a very economical construction method as indicated in FIG. 2. After completion of the primary structure, that is, the longitudinal girders 1, 2 or the strut frame with the cantilever arms 13, 14 or 18, 19 in place on the vertical supports in a procedure known per se, the roadway slab 5 of the secondary structure can be formed and poured at a construction site F located adjacent one of the abutments 8. The individual roadway sections 5*a*–5*d* are each poured in a stationary formwork and, after being completed, can be taken out of the formwork and moved along the bearings 3 on the primary structure into the final position of the roadway section on the bridge. In FIG. 2, the primary structure, made up of the elongated girders 1, 2, is completed and the roadway sections 5*a* of the roadway slab 5 are moved from the site F over the bearings 3 into position on the primary structure, note the roadway sections move in the direction of the arrow 23.

In moving the roadway sections, it is necessary only to provide sliding paths, such as polished metal plates, on which the roadway slab sections can slide over the bearings 3. The sliding path can be located on the underside of the roadway sections, that is, along the underside of the increased thickness sections 6, note FIG. 1, where such sections are located directly above the girders. Alternatively, the sliding path can be provided along the upper side of the elongated girders. The fixed bearings are set in place after the roadway sections are in the final position.

The invention is not limited to the simple cross-sectional arrangement as shown in FIG. 1, patterned after the T-beam cross-section, rather other bridge cross-sectional forms can be used. Two additional embodiments are shown in FIGS. 7 and 8.

Figure 7:
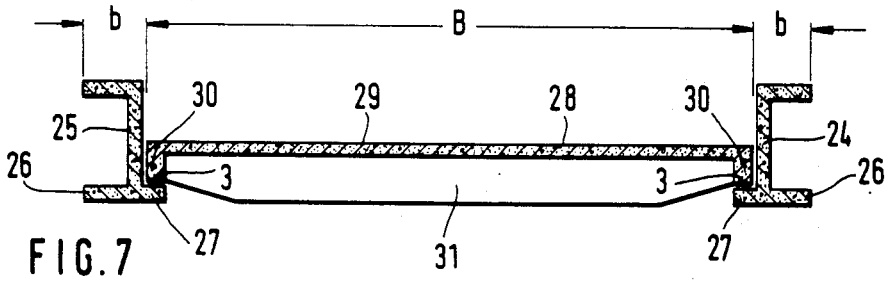
FIG. 7 is a cross-sectional view of a trough-like bridge illustrating another embodiment of a bridge support system.

In the bridge cross-section in FIG. 7, longitudinal girders 24, 25 are in the form of U-shaped members with the opening of the U-shaped section facing outwardly. The lower flange or leg of each U-shaped section has an inwardly directed projection 27 with these projections forming continuous brackets for the bearings 3, 11. Roadway slab 28 consists of a thin plate-like member reinforced along its opposite edges by downwardly extending walls and by a beam 31 extending transversely across the plate-like member.

Figure 8:
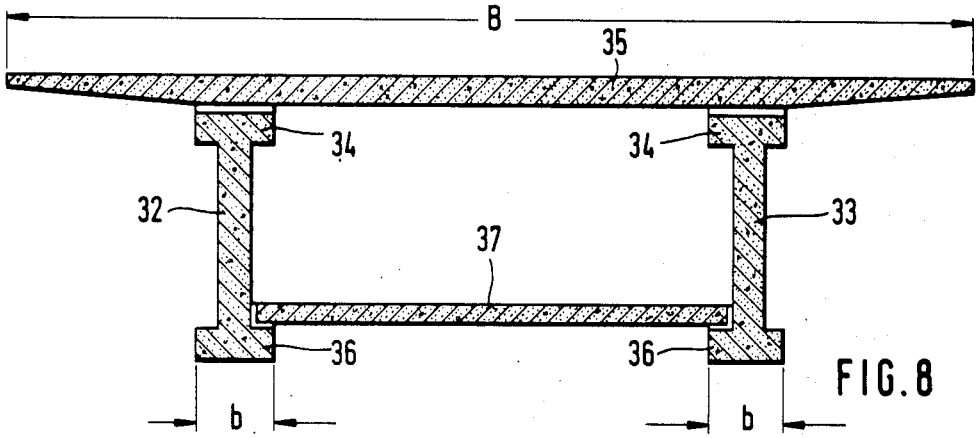
FIG. 8 is a cross-sectional view, similar to FIG. 7, illustrating the bridge support system in a box-type bridge.

Further, in accordance with the present invention, a hollow box-type cross-section can be used, note FIG. 8. The box-like shape is formed by a pair of elongated girders 32, 32 extending in the long direction of the bridge with upper flanges 34 supporting the roadway slab 35 and with the inner parts of lower flanges 36 supporting a base plate 37. In this arrangement, there is the possibility of connecting the individual parts forming the cross-section with one another so that they are resistant to shear forces and/or bending forces if they are built in a successive manner and the individual sections of the secondary structure are moved into the final position by moving the roadway sections over the parts making up the primary structure.

While specific embodiments of the invention have been shown and described in detail to illustrate the application of the inventive principles, it will be understood that the invention may be embodied otherwise without departing from such principles.

I claim:

1. Support system for a multiple-span bridge constructed of one of reinforced concrete and prestressed concrete comprises a primary structure arranged to span the space between an upright abutment and an upright intermediate support and between intermediate supports of the multiple span bridge, said primary structure comprises support members elongated in the long direction of the bridge and said support members being serially arranged in the long direction with expansion joints located between the adjacent ends of said serially arranged support members, said support members having a width extending transversely of the elongated direction thereof which is a fraction of the full useful bridge width, and a secondary structure supported on said primary structure and including a roadway slab extending in the elongated direction of said primary structure and for approximately the full useful width of the bridge, wherein the improvement comprises that said secondary structure includes a plurality of roadway slab sections each extending for the full useful bridge width and serially arranged in the elongated direction of said primary structure with expansion joints extending transversely of the elongated direction and located between adjacent ends of said roadway slab sections, bearing means located on said support members, said roadway slab sections being supported on said bearing means and the adjacent ends of said roadway slab sections being spaced closely apart relative to the length of the span between the abutments and intermediate supports, said roadway slab sections extending in the elongated direction across said expansion joints between said support members, said expansion joints of said roadway slab section being offset in the elongated direction relative to the expansion joints of said support member, the spacing of said expansion joints between said roadway slab sections is at least equal to the spacing between the expansion joints in said primary structure, said bearing means include pivot point bearings movable to all sides thereof, said pivot point bearing are formed fo an elastomer material, and at least one fixed bearing for each said elongated support member for supporting each said roadway slab section on said primary structure for transmitting horizontal longitudinally extending forces to said primary structure.

2. Support system, as set forth in claim 1, wherein the length of said roadway slab sections is a multiple of the length of said elongated support members and several serially arranged elongated support members are connected with one another along one said roadway slab section by means of said pivot point bearings and fixed bearings for transmitting horizontally extending longitudinal forces to said primary structure for introduction into one of the abutment of intermediate supports.

3. Support system, as set forth in claim 1, wherin said leongated support members of said primary structure are single-span girders.

4. Support system, as set forth in claim 1, wherein said primary structure includes upwardly extending supports and said support members comprise a pair of cantilever arms extending outwardly from opposite sides of said upwardly extending supports, and said upwardly extending supports are arranged to be fixed to a foundation for forming a bending resistant unit.

5. Support system, as set forth in claim 4, wherein the adjacent end of said cantilever arms are connected together by a shear joint.

6. Support system, as set forth in claim 5, wherein said fixed bearings are located between said secondary structure and said primary structure in the region of said upwardly extending supports.

7. Support system, as set forth in claim 6, wherein said expansion joints in said secondary structure are located in the region above said upwardly extending supports.

* * * * *